US006619926B2

(12) United States Patent
Manole et al.

(10) Patent No.: US 6,619,926 B2
(45) Date of Patent: Sep. 16, 2003

(54) CAM AND CRANK ENGAGEMENT FOR A REVERSIBLE, VARIABLE DISPLACEMENT COMPRESSOR AND A METHOD OF OPERATION THEREFOR

(75) Inventors: Dan M. Manole, Tecumseh, MI (US); Elizabeth A. Robbins, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 93 days.

(21) Appl. No.: 09/951,231

(22) Filed: Sep. 12, 2001

(65) Prior Publication Data

US 2003/0049136 A1 Mar. 13, 2003

(51) Int. Cl.[7] ..... F09B 7/06
(52) U.S. Cl. ..... 417/53
(58) Field of Search ..... 417/53, 413.1, 417/415, 44.1, 45

(56) References Cited

U.S. PATENT DOCUMENTS

| | | | | |
|---|---|---|---|---|
| 319,051 | A | | 6/1885 | Avery |
| 813,433 | A | | 2/1906 | Johnson |
| 3,010,339 | A | | 11/1961 | Brock |
| 3,401,639 | A | | 9/1968 | Schwertfeger et al. |
| 3,738,230 | A | | 6/1973 | Censi |
| 3,796,523 | A | | 3/1974 | Albrecht et al. |
| 4,028,018 | A | | 6/1977 | Audsley |
| 4,236,874 | A | | 12/1980 | Sisk |
| 4,245,966 | A | | 1/1981 | Riffe |
| 4,248,053 | A | | 2/1981 | Sisk |
| 4,302,163 | A | | 11/1981 | Hope et al. |
| 4,479,419 | A | | 10/1984 | Wolfe |
| 4,494,447 | A | | 1/1985 | Sisk |
| 4,777,866 | A | | 10/1988 | Tan |
| 5,199,857 | A | | 4/1993 | Sanuki |
| 5,281,110 | A | | 1/1994 | Dreiman |
| 5,366,355 | A | | 11/1994 | Patterson |
| 5,560,460 | A | | 10/1996 | Ezawa |
| 5,570,769 | A | | 11/1996 | Eicher et al. |
| 5,609,127 | A | | 3/1997 | Noplis |
| 5,951,261 | A | | 9/1999 | Paczuski |
| 6,099,259 | A | * | 8/2000 | Monk et al. ..... 417/15 |
| 6,132,177 | A | * | 10/2000 | Loprete et al. ..... 417/221 |
| 6,190,137 | B1 | | 2/2001 | Robbins et al. |
| 6,331,925 | B1 | * | 12/2001 | Loprete et al. ..... 361/22 |
| 6,389,823 | B1 | * | 5/2002 | Loprete et al. ..... 62/89 |
| 6,446,451 | B1 | * | 9/2002 | Monk et al. ..... 62/228.5 |

* cited by examiner

*Primary Examiner*—Teresa Walberg
*Assistant Examiner*—Vinod D. Patel
(74) *Attorney, Agent, or Firm*—Baker & Daniels

(57) ABSTRACT

A reversible reciprocating piston compressor includes a crankcase defining at least one cylinder therein and a crankshaft rotatably supported by the crankcase. The crankshaft includes a drive portion and a crankpin eccentrically positioned relative to an axis of rotation of the crankshaft. A piston is reciprocable within the cylinder and a connecting rod assembly is provided between the crankpin and the piston to reciprocally drive the piston in response to forward or reverse rotation of the crankshaft. A cam assembly is operably connected to the crankpin and is engageable with the drive member to effectuate a first stroke length in a first direction of rotation of the crankshaft and a second stroke in a second direction of rotation of the crankshaft. The cam assembly includes a cam, a driven portion and a counterweight. The cam is interposed between the connecting rod assembly and the crankpin and the driven portion is attached to the cam and is in a contacting relationship with the drive portion through at least one contact interface. The contact interface is oriented at a non-zero angle to a radial reference originating from a centerline axis of the crankpin. The counterweight is attached to the cam and has a center of mass located radially adjacent to or through the contact interface. The drive portion is engageable and disengageable with the driven portion through sliding movement of the drive portion relative to the driven portion along the contact interface.

25 Claims, 8 Drawing Sheets

CAM AND CRANK ENGAGEMENT FOR A REVERSIBLE, VARIABLE DISPLACEMENT COMPRESSOR AND A METHOD OF OPERATION THEREFOR

BACKGROUND OF THE INVENTION

The present invention pertains to reversible reciprocating piston machines, and particularly to reversible hermetic reciprocating piston compressors. More specifically, the present invention relates to compressors including an eccentric cam operably engaged with a crankpin and connecting rod to provide a first piston stroke in a first direction of crankshaft rotation and a second piston stroke in a second direction of crankshaft rotation.

Reciprocating piston compressors, such as the compressor disclosed in U.S. Pat. No. 5,281,110, which is assigned to the present assignee, the disclosure of which is incorporated herein by reference, are generally of fixed displacement and powered by an electric motor which rotates in a single direction. Also known in the art are reversible hermetic reciprocating piston compressors in which a piston has a first stroke length when driven by a crankshaft rotating in a first, forward direction, and a second stroke length when driven by the crankshaft rotating in a second, reverse direction. Two separate stroke lengths are achieved through use of an eccentric cam which rotates relative to the crankshaft between stops thereon corresponding to first and second angular cam positions which, in turn, correspond to the first and second stroke lengths. These reversible compressors provide the advantage of having one displacement when the crankshaft is rotated in the forward direction, and another displacement when the crankshaft is rotated in the reverse direction. Typical variable stroke, reversible drive compressors, however, do not provide means for positively maintaining engagement between the cam stop and the crankshaft corresponding to the greater stroke length during rotation of the crankshaft without a latching mechanism which holds the cam and crankshaft in engagement during rotation in one of these two directions. If the cam and crankshaft are not continually maintained in engagement during crankshaft rotation, the reexpansion of gas in the cylinder after the piston reaches top-dead-center (TDC) may force the piston away from its TDC position at such a speed that the cam may rotate relative to the crankshaft, separating the cam and crankshaft stops. The separation of these stops result in their subsequently slamming together as the rotating crankshaft catches up to the cam, causing considerable component stresses, adversely affecting durability, and producing undesirable noise.

To prevent this undesirable loss of contact between the crank and the cam a reversible reciprocating compressor was adapted with a centrifugally activated latching mechanism which coupled the crank with the cam when the crank was rotating in the forward direction. The disclosure of a reversible reciprocating compressor employing a latching mechanism is provided in U.S. Pat. No. 5,951,261 to Paczuski and U.S. Pat. No. 6,190,137 to Robbins et al., both of which are assigned to the assignee of the present application, the disclosures of which are expressly incorporated herein by reference. Although effective in maintaining contact between the cam and crankshaft, implementing the latching mechanism requires multiple parts and additional machining at a significant additional cost.

U.S. Pat. No. 6,132,177 to Loprete et al. discloses a reversible reciprocating compressor having a flyweight incorporated into the cam assembly exerting a centrifugal force which is transmitted to the crankshaft from the cam assembly to prevent separation of the cam and crankshaft. The flyweight is located opposite the engagement between the cam assembly and the crankshaft. As the rotational speed of the crankshaft increases, the flyweight imparts a force influencing the cam assembly and crankshaft into engagement. However, since the centrifugal force is effective after the crankshaft has gained significant rotation, the flyweight has significantly less effect at low crankshaft speeds, i.e., at start-up. As a result, undesirable noise and damage due to impact may occur during insignificant crankshaft speeds.

What is needed is a reversible compressor assembly which is simple in construction and is adapted to avoid undesirable impact between the cam and crankshaft at any crankshaft speed and in either direction. Further, a reversible compressor which significantly reduces wear or other damage of the contacting surfaces defined by the crankshaft and the cam assembly, is desirable.

SUMMARY OF THE INVENTION

The present invention overcomes the disadvantages of prior reversible compressor assemblies by providing a reversible, variable stroke compressor assembly including a crankshaft having a drive portion coacting with a driven portion of a cam assembly through lubricated sliding engagement and disengagement between the contacting surfaces to reduce impact, noise and damage.

The present invention provides a reversible reciprocating piston compressor including a crankcase defining at least one cylinder therein, and a crankshaft which rotates in opposite, forward and reverse directions and is rotatably supported by the crankcase. The crankshaft includes a drive portion and a crankpin eccentrically positioned relative to an axis of rotation of the crankshaft. A piston is reciprocable within the cylinder and a connecting rod assembly is provided between the crankpin and the piston to reciprocally drive the piston in response to forward or reverse rotation of the crankshaft. A cam assembly is operably connected to the crankpin and is engageable with the drive member to effectuate a first stroke length in a first direction of rotation of the crankshaft, and a second stroke in a second direction of rotation of the crankshaft. The cam assembly includes a cam, a driven portion and a counterweight. The cam is interposed between the connecting rod assembly and the crankpin. The driven portion is attached to the cam and is in a contacting relationship with the crankshaft drive portion through at least one contact interface. The contact interface is oriented at a non-zero angle to a radial reference originating from a centerline axis of the crankpin. The counterweight is attached to the cam and has a center of mass located radially adjacent to or through the contact interface. The drive portion is engageable and disengageable with the driven portion through sliding movement of the drive portion relative to the driven portion along the contact interface.

The present invention further provides a reversible reciprocating piston compressor including a counterweight attached to the cam and being structured and arranged to provide an inertial force directed through a center of mass of the cam. The center of mass of the cam is located radially adjacent or through the contact interface. The driven portion and the drive portion resist separation under the influence of the inertial force.

The present invention further provides a reversible reciprocating piston compressor having a counterweight attached to the cam being structured and arranged to provide a centrifugal force on the cam assembly when the crankshaft has attained a running speed. The centrifugal force urges a reduction in a force of contact exerted by the drive portion on the driven portion to thereby retain a film of lubricating oil between the drive and driven portions.

The present invention further provides a reversible reciprocating piston compressor including a crankcase defining at least one cylinder therein, and a crankshaft which rotates in opposite, forward and reverse directions and is rotatably supported by the crankcase. The crankshaft includes a drive portion and a crankpin eccentrically positioned relative to an axis of rotation of the crankshaft. A piston is reciprocable within the cylinder and a connecting rod assembly is provided between the crankpin and the piston to reciprocally drive the piston in response to forward or reverse rotation of the crankshaft. A cam assembly is operably connected to the crankpin and is engageable with the drive member to effectuate a first stroke length in a first direction of rotation of the crankshaft, and a second stroke in a second direction of rotation of the crankshaft. The cam assembly includes a cam and a driven portion. The cam is interposed between the connecting rod assembly and the crankpin. The driven portion is attached to the cam and is in a contacting relationship with the crankshaft drive portion through at least one contact interface. The contact interface is oriented at a non-zero angle to a radial reference originating from a centerline axis of the crankpin. The compressor includes structure for slidingly engaging and disengaging the drive portion with the driven portion through sliding movement of the drive portion relative to the driven portion along the contact interface.

The present invention further provides a method for compressing gas with a reciprocating piston compression device, including receiving a gas to be compressed into a cylinder of the compression device; rotating a crankshaft drive member in a first rotational direction; engaging a first surface of a camshaft driven member with a first surface of the crankshaft drive member through sliding movement between the drive and driven members; driving the cam in the first rotational direction; moving a piston operably connected to the cam assembly a first stroke distance; compressing the gas within the cylinder of the compression device; rotating the crankshaft drive member in a second rotational direction such that a second surface of a crankshaft drive member is rotated in a second rotational direction opposite the first rotational direction; engaging a second surface of the camshaft driven member with the second surface of the crankshaft drive member through sliding movement between the drive and driven members; driving the cam in the second rotational direction; and moving the piston operably connected to the cam assembly a second stroke distance.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
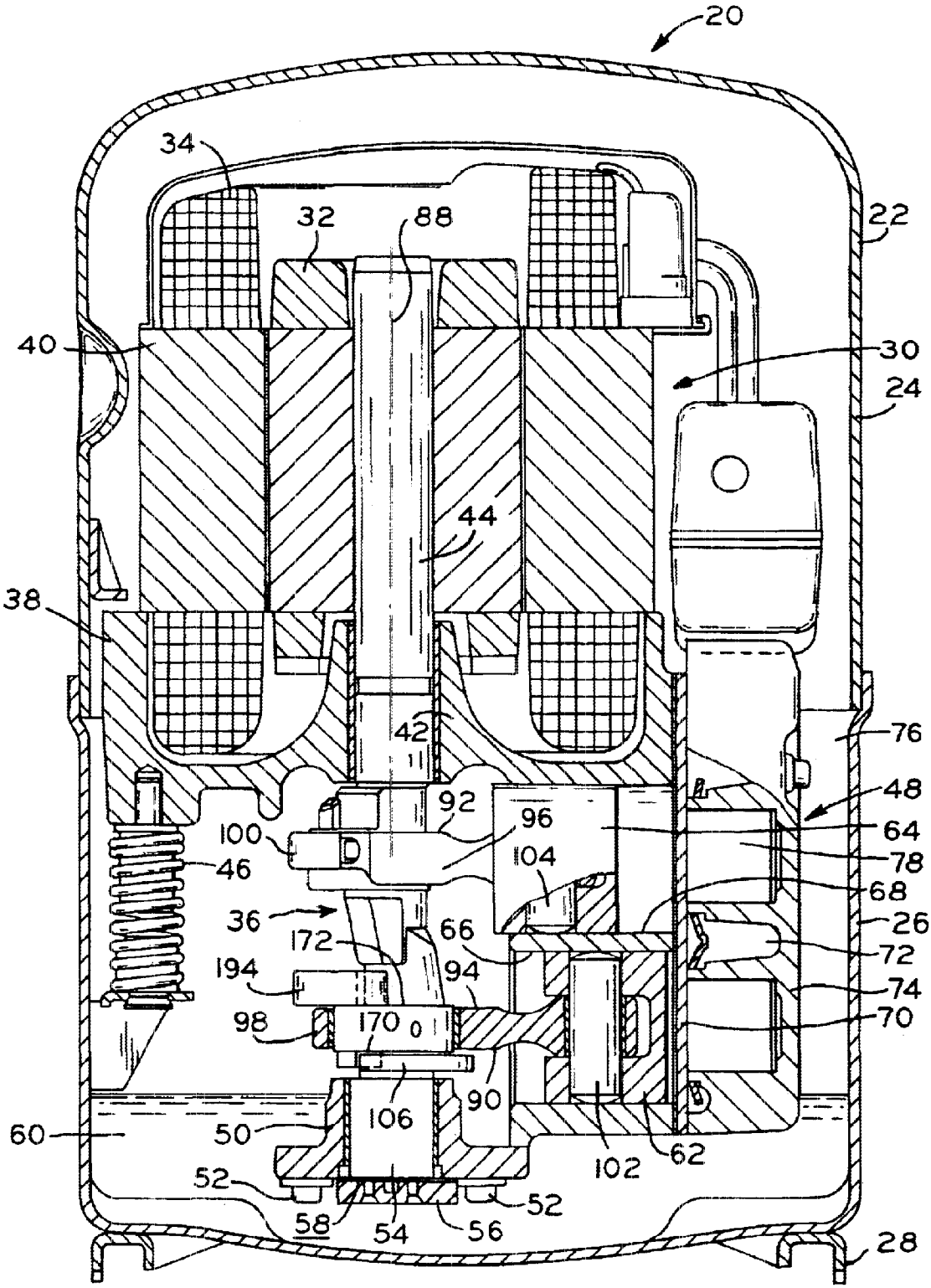
FIG. 1 is a sectional side view showing a first embodiment of a compressor according to the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention and such exemplifications are not to be construed as limiting the scope of the invention in any manner.

DETAILED DESCRIPTION OF THE INVENTION

Referring to FIG. 1 compressor assembly 20, which may be utilized in a refrigeration or air conditioning system (not shown), includes hermetically sealed housing 22 having top portion 24 and bottom portion 26 welded or brazed together. Mounting bracket 28 is attached to bottom housing portion 26 to position compressor 20 in an upright or vertical position. Although compressor assembly 20 is shown having a vertical orientation, the scope of the present invention encompasses compressors having a horizontal orientation as well.

Reversible electric motor assembly 30 is located within housing 22 and includes cylindrical rotor 32 extending through the center of annular stator 34. Crankshaft 36 is attached to rotor 32 by means of an interference fit, for example. Stator 34 is supported in housing 22 by means of its attachment to crankcase 38, as is customary. Stator 34 includes windings 40 comprised of two individual portions separately and selectively energized for forward and reverse rotation of rotor 32 activated by a switch (not shown) mounted external to the compressor. A terminal cluster (not shown) is provided in housing 22 for connecting the windings to a switched source of electrical power.

Crankcase 38 has central bearing portion 42 which radially supports upper journal portion 44 of crankshaft 36. Shock mounts 46, attached to crankcase 38 and lower housing portion 26, support electric motor assembly 30 and compressor mechanism 48 within housing 22. Outboard bearing 50, attached to crankcase 38 by bolts 52, radially supports crankshaft lower journal portion 54. Additionally, bolts 52 attach thrust bearing plate 56 to outboard bearing 50, and thrust bearing plate 56 axially supports end surface 58 of crankshaft 36.

Lower housing portion 26 forms sump 60, containing liquid lubricant, such as oil, therein, to lubricate compressor mechanism 48. Pistons 62 and 64 respectively reciprocate within cylinders 66 and 68 of equal diameter formed in crankcase 38. Refrigerant gas is drawn into cylinders 66 and 68 at suction pressure and is expelled therefrom in a compressed state at discharge pressure through respective, valved suction and discharge ports in valve plate 70. In a well known manner, refrigerant gas is drawn through the suction ports of plate 70 and into the cylinders through the suction valves from suction chamber 72 of head 74. Head 74 is attached to crankcase 38 by means of bolts (not shown) which extend through valve plate 70. Suction chamber 72 is fluidly connected to the interior chamber 76 of compressor assembly 20, which receives low pressure refrigerant gas from the system. Compressed refrigerant gas is forced from the cylinders through the discharge ports of plate 70 and into discharge chamber 78 of head 74. The discharge gas then exits through a tube (not shown) which extends through the housing wall and provides compressed refrigerant to the system.

Figure 2:
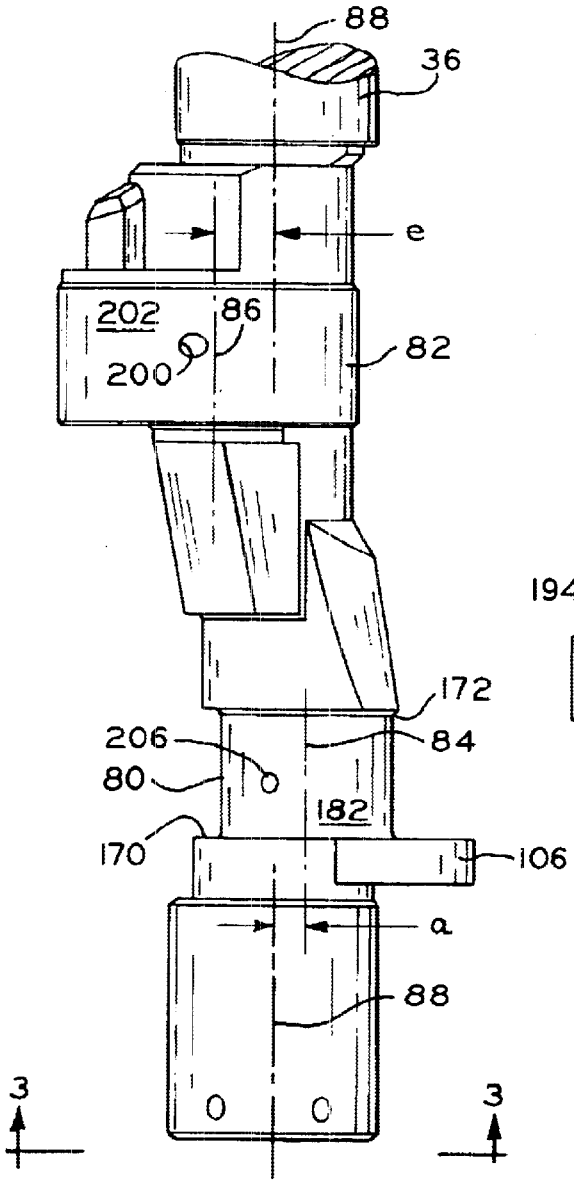
FIG. 2 is a fragmentary side view of the crankshaft of the compressor of FIG. 1.

Referring to FIG. 2, crankshaft 36 includes outboard crankpin 80 and inboard crankpin 82. Outboard and inboard crankpins 80, 82 each include respective centerline axes 84, 86. Crankshaft 36 includes axis of rotation 88 which is offset relative to centerline axis 84 of crankpin 80 by distance "a" and offset relative to centerline axis 86 of crankpin 82 by distance "e". Centerline axes 84, 86 and axis 88 lie in a plane, with axis 84 located 180° about centerline axis 88 from centerline axis 86. Centerline axes 84, 88 are offset by distance e, the eccentricity of inboard crankpin 82, which corresponds to one half the stroke distance of piston 64 in cylinder 68. Pistons 62, 64 are reciprocatively driven by respective crankpins 80, 82 through connecting rod assemblies 90, 92 (FIG. 1). Connecting rod assemblies 90, 92, comprising connecting rods 94, 96 and rod straps 98, 100, are pivotally attached to pistons 62, 64 through wrist pins 102, 104 (FIG. 1).

Figure 4:
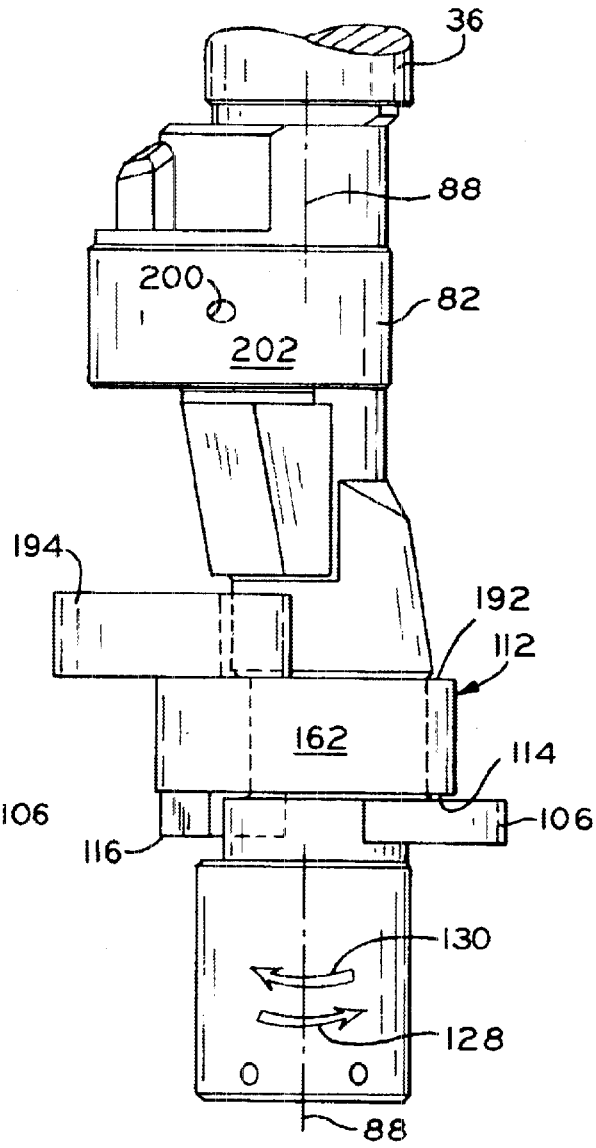
FIG. 4 is a fragmentary side view of the crankshaft with a cam assembled thereto.
Figure 3:
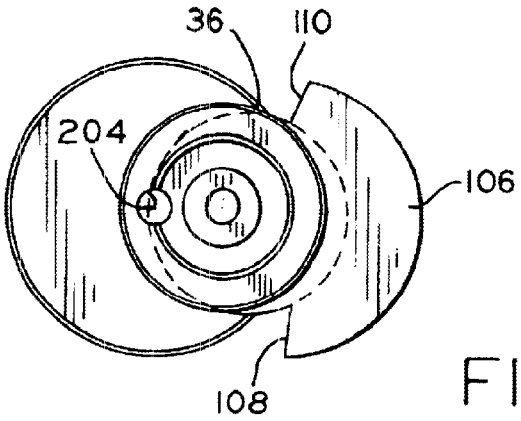
FIG. 3 is an end view of the crankshaft viewed along line 3—3 of FIG. 2.
Figure 5:
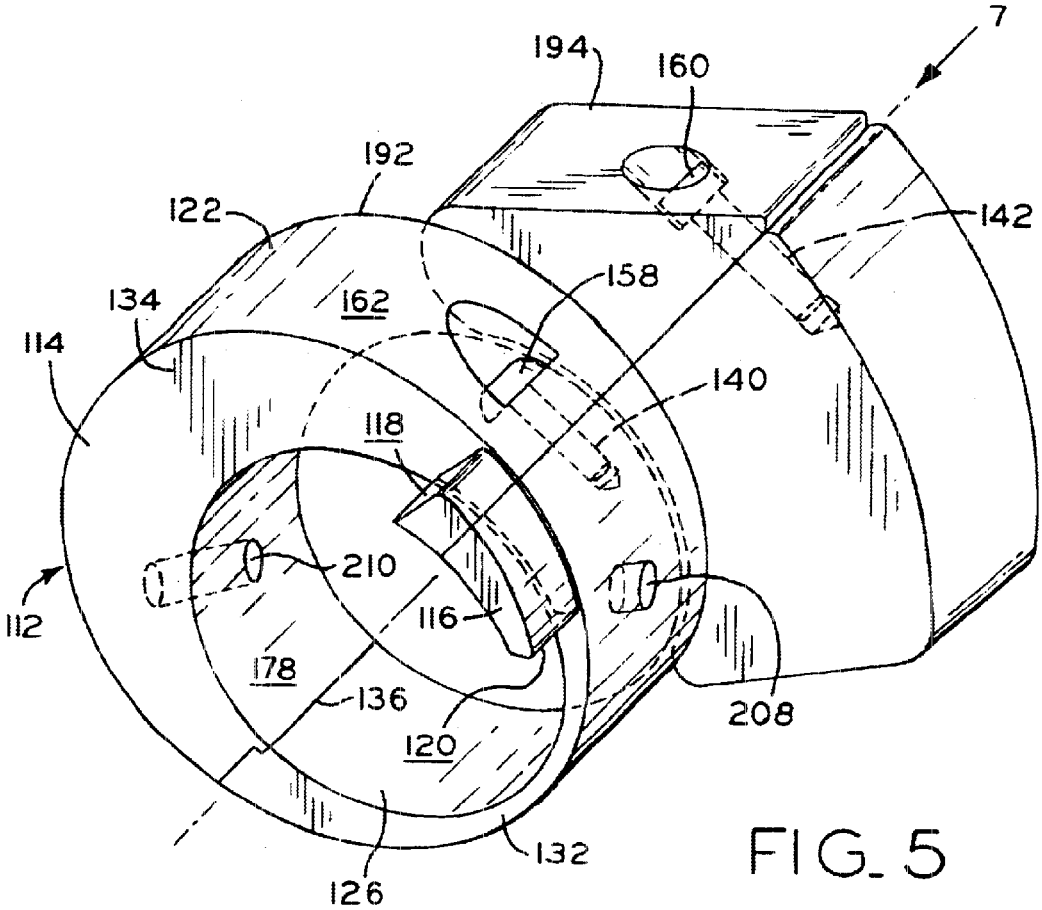
FIG. 5 is a perspective view of the cam assembly of the compressor of FIG. 1.
Figure 8:
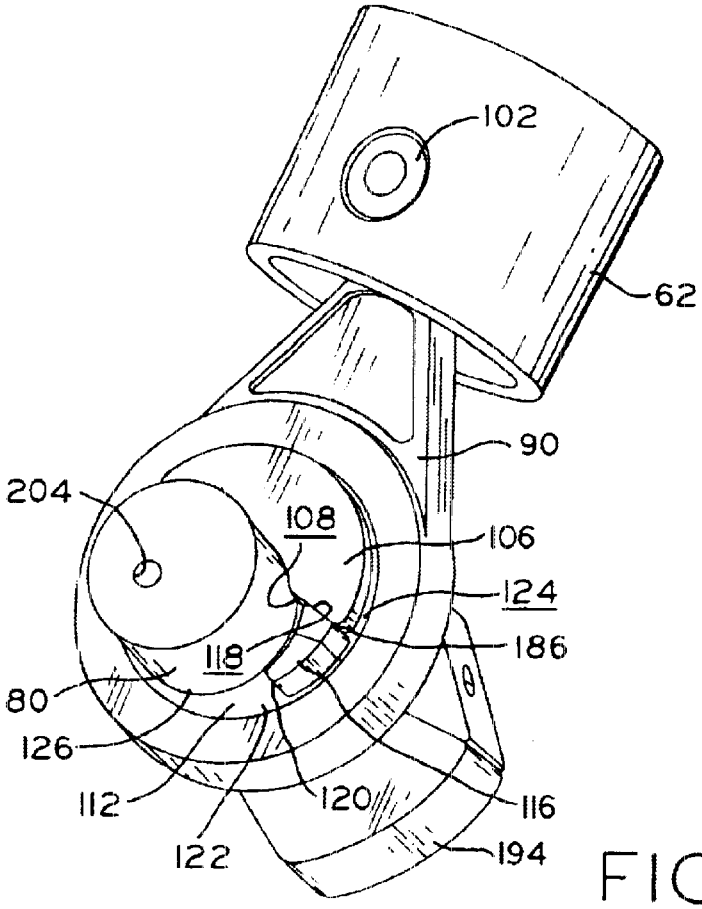
FIG. 8 is a perspective view of the crankshaft and cam assembly of FIG. 1, illustrating the crankshaft in section, engaged with its corresponding piston and connecting rod assembly.

Crankshaft 36 includes drive flange 106 situated adjacent to outboard crankpin 80 and has first and second drive surfaces 108 and 110, respectively (FIG. 3). Drive flange 106 extends substantially perpendicularly to axis 88 and coacts with annular cam 112 provided between connecting rod assembly 90 and crankpin 80 to rotate cam 112 either in the forward or reverse direction (FIG. 8). Referring to FIG. 5, located on lateral surface 114 of cam 112 is raised driven portion 116 which includes first and second driven surfaces 118, 120 alternatively driven by respective first and second driving surfaces 108, 110 (FIG. 3) of drive flange 106 as hereinafter described. As best seen in FIG. 8, outer periphery 122 of cam 112 is rotatably engaged with annular bearing surface 124 of connecting rod assembly 90. Crankpin 80 of crankshaft 36 extends through eccentrically positioned hole 126 in cam 112 and periphery 122 of cam 112 orbits about crankpin 80 to provide varying piston strokes corresponding to forward rotation (arrow 128) and reverse rotation (arrow 130) of crankshaft 36 (FIG. 4).

Figure 6A:
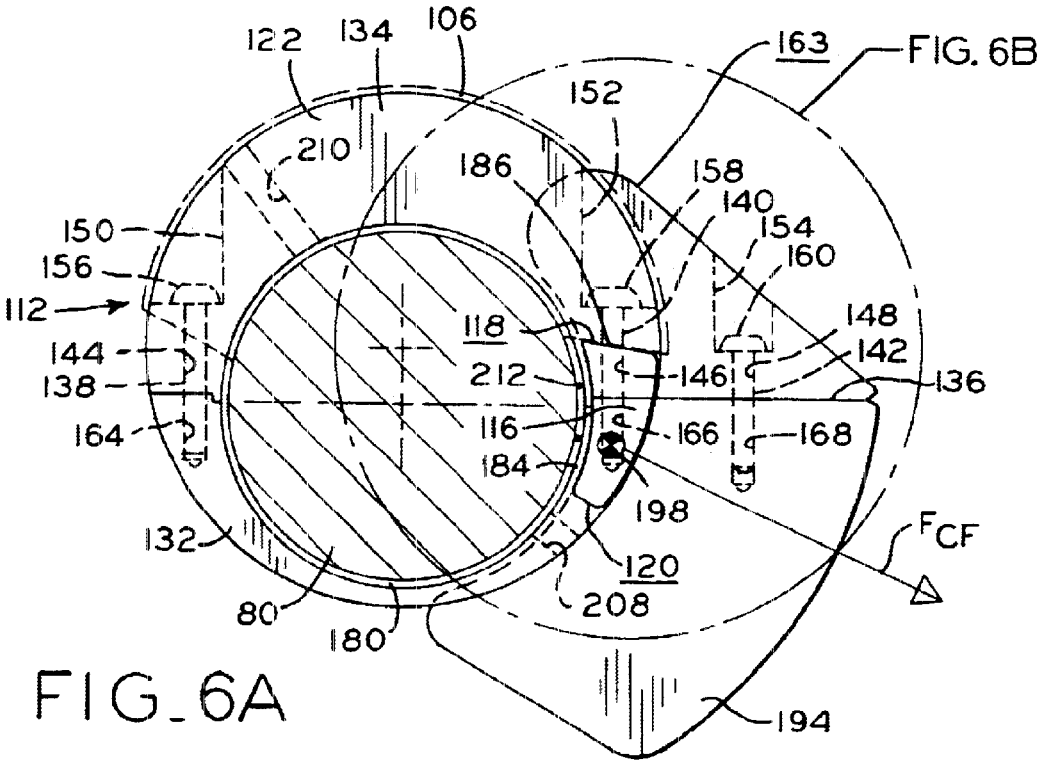
FIG. 6A is an end view of the cam assembly of FIG. 1, illustrating the drive flange of the crankshaft in ghosted lines and the crankshaft in section.
Figure 6B:
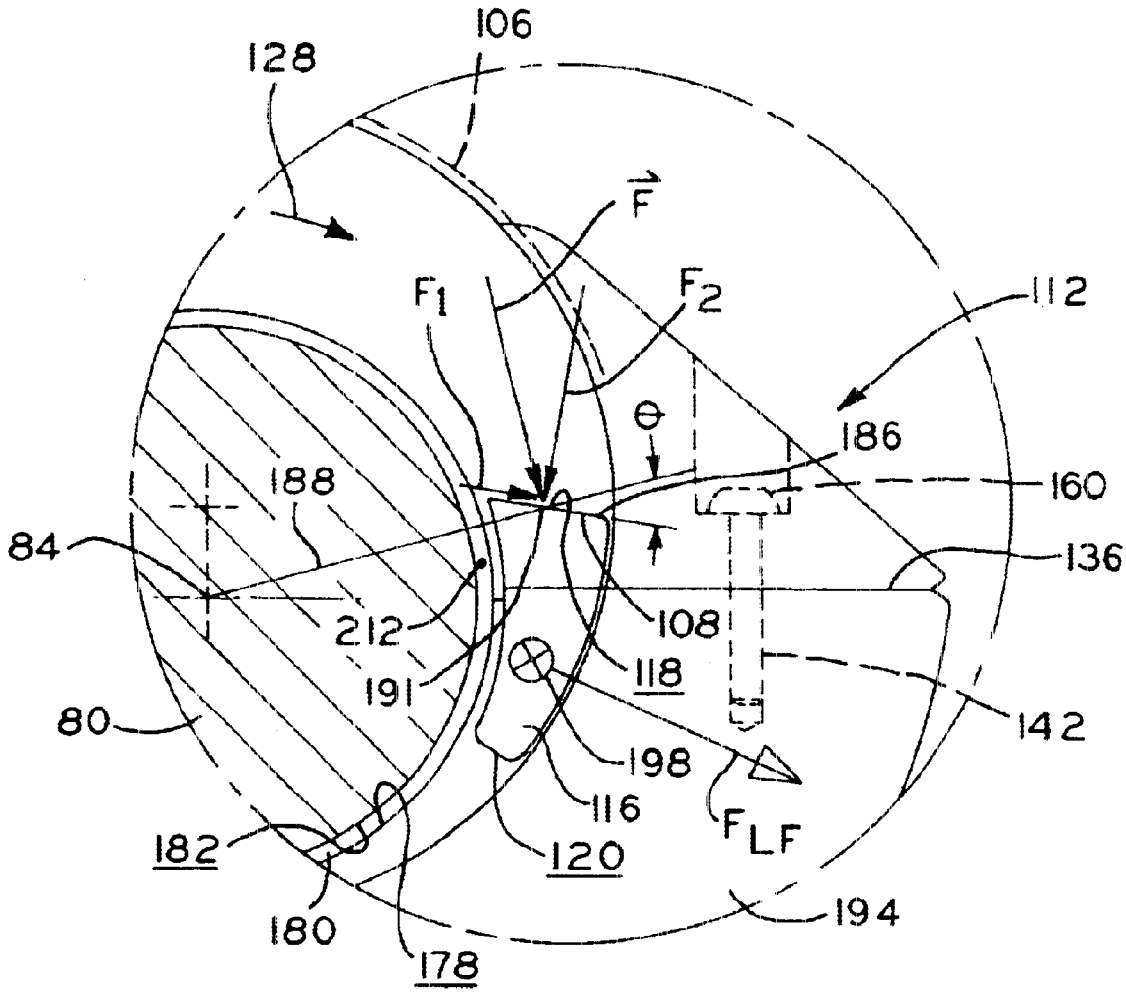
FIG. 6B is an enlarged view of the area encircled in FIG. 6A, depicting the components of force exerted by the drive flange on the cam assembly.
Figure 7:
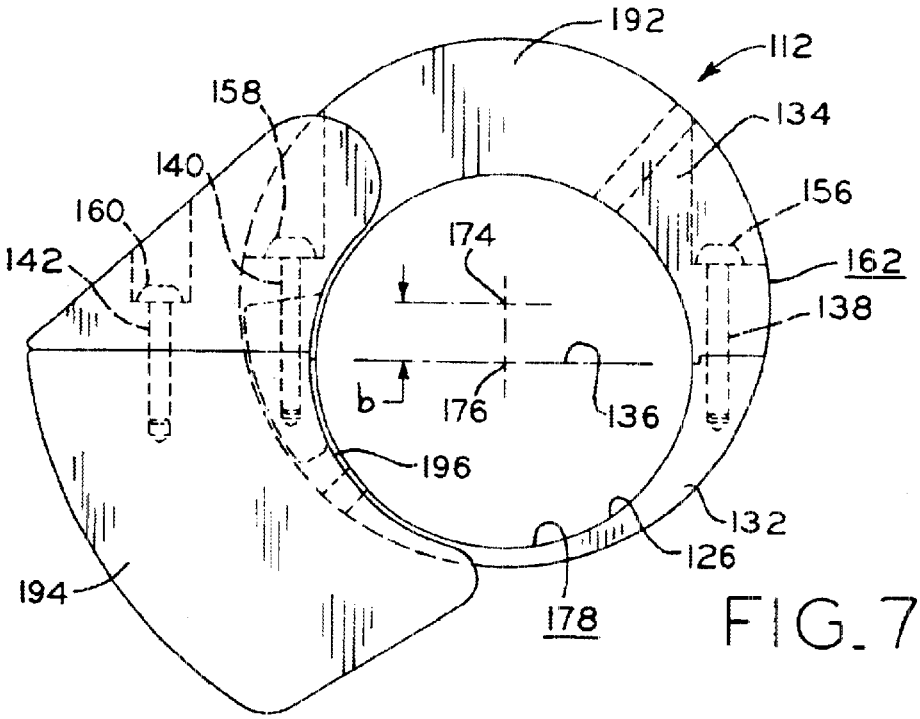
FIG. 7 is an end view of the cam assembly of FIG. 5 in the direction of arrow 7, showing the cam counterweight.

Referring to FIGS. 5–7, there is shown a first embodiment of a cam assembly according to the present invention. Cam assembly 112 includes first and second members 132, 134 which join along parting line 136 to form cam assembly 112. First and second members 132, 134 may be heat treated and nitrided sintered, powder metal, for example, and are assembled about outboard crankpin 80 as shown in FIGS. 6A and 8. First member 132 and second member 134 of cam 112 are a matched pair and are joined by screws 138, 140 and 142 (FIG. 7). Second member 134 includes through holes 144, 146 and 148 which include counterbores 150, 152 and 154 to recess heads 156, 158, 160 of respective screws 138, 140, 142 such that the screw heads do not outwardly project from outer margins of cam 112. Notably, screw heads 156 and 158 are completely recessed below bearing surface 162 of cam 112 such that cam 112 may rotate freely within inner surface 124 of connecting rod assembly 90. First member 132 of cam 112 includes corresponding threaded holes 164, 166 and 168 which align with through holes 146, 148, 150. As an alternative to bolting first and second members, it is contemplated that first and second members 132, 134 may be retained in place without using fasteners. Specifically, the cam may be radially retained by inner cylindrical surface 124 (FIG. 8) of connecting rod assembly 90 and axially retained by adjacent, abutting axial surfaces 170, 172 of crankshaft 36 (FIG. 2). As a further alternative, it is envisioned that the cam may comprise a single piece having the same overall shape and features as interfitted portions 132, 134, illustrated in FIG. 5. The single piece eccentric cam may be assembled with the crankshaft by either moving it axially along a single piece crankshaft and onto its corresponding crankpin, or by providing a segmented crankshaft which is accordingly assembled subsequent to placement of the cam upon the crankpin.

Referring to FIG. 7, first and second members 132, 134 of cam 112 define cylindrical outer surface 162 having central axis 174 which is parallel to and offset relative to central axis 176 of interior cylindrical surface 178 of eccentric hole 126 in cam 112. When cam 112 is assembled to crankshaft 36, axis 176 is substantially coincident with central axis 84 of outboard crankpin 80 (FIG. 2). As best seen in FIG. 6B, annular clearance 180, located between outer surface 182 of crankpin 80 and inner surface 178 of cam 112, is provided to allow crankpin 80 to freely rotate relative to cam 112. Axes 174 and 176 are offset by distance "b" which, in the exemplary embodiment of compressor assembly 20, is equivalent to distance "a", illustrated in FIG. 2.

Driven portion 116 of cam 112 is positioned along a first edge portion 184 (FIG. 6A) of offset hole 126. Driven surfaces 118, 120 are alternatively engaged by drive surface 108 (FIG. 9) of drive flange 106, in the forward direction 128, and drive surface 110 (FIG. 10), in the reverse direction 130. Referring to FIG. 6B, when rotated in forward direction 128, drive and driven surfaces 108, 118 form contact interface 186 in a plane parallel with axis 84. Contact interface 186 continuously changes orientation relative to axis of rotation 88 of crankshaft, however, those having ordinary skill will understand that contact interface 186 forms a fixed angle θ relative to a radially extended reference 188 originating from centerline axis 84 of crankpin 80 and extending through centerpoint 191 of contact interface 186. Since cam 112 and drive flange 106, concomitantly rotate about centerline 84 of crankpin 80, angle θ is fixed as long as drive and driven portions 108, 118 are engaged. Similarly, drive and driven surfaces 110, 120 (in the reverse direction) form planar interface 190 positioned at fixed angle α relative to radially extended reference 193 originating from centerline axis 84 of crankpin 80 (FIG. 10). Referring to FIGS. 5 and 7, lateral inboard face 192 of cam 112 includes counterweight 194 attached thereto or integrally formed therewith, and which extends in an axial direction opposite that of which raised driven portion 116 extends from cam outboard face 114. Counterweight 194 projects radially from edge portion 196 (FIG. 7) of through hole 126 of cam 112 and prevents impact between drive flange 106 and driven portion 116 as described hereinafter.

Referring to FIG. 6A, it may be seen that counterweight 194 is located radially adjacent raised driven portion 116, and consequently, radially adjacent contact interfaces 186, 190 (FIG. 10). By locating center of mass 198 of cam assembly 112 proximate to contact interfaces 186, 190 (FIG. 10), an inertial force provided by the counterweight opposes the separation of drive flange 106 and driven portion 116 during low torque operation, and reexpansion. Low torque operation of compressor 20 generally occurs during the suction stroke of the piston, and as a result, an insignificant amount of force is transmitted between driven portion 116 of cam 112 and flange 106 of crankshaft 36. Prior art reversible reciprocating compressor assemblies, not employing a latching mechanism, are susceptible to separation of the crankshaft and cam corresponding to low torque operation of the compressor, resulting in undesirable impact and noise. In sharp contrast, the inventive compressor assembly 20 includes drive and driven surfaces 108, 118 which gradually and slidably coact to prevent separation and the ensuing slamming impact between the cam and the crankshaft.

During engagement of drive and driven surfaces 108, 118, central axis 176 of cam 112 tends to shift off center, or become misaligned, relative to centerline axis 84 of crankpin 80. Consequently, annular clearance 180 deforms from its uniformly annular shape and drive and driven surfaces 108, 118 begin to slide relative to one another. This sliding engagement results in a damped or shock absorbing phenomena during engagement. Similarly, when drive and driven surfaces 108, 118 disengage, sliding movement occurs prior to separation as clearance 180 is being restored. Thus, a significant degree of dampening is also associated with drive and driven surfaces 108, 118 as they disengage.

Referring to FIG. 6B, it may be seen that angle θ of interface 186 relative to radial reference line 188 enhances the aforesaid sliding engagement between drive and driven surfaces 108, 118 by providing a component of force $F_1$ in the direction of sliding motion along contact interface 186. Drive surface 108 of drive flange 106 contacts driven surface 118 of cam 112 exerting a tangentially directed force $\vec{F}$ relative to centerline 84 of crankpin 80. The maximum torque transferred from crankshaft 36 to cam 112 is tangentially directed relative to centerline 84 of crankpin 80, hence, force $\vec{F}$ is tangentially directed or perpendicular relative to radial reference line 188 having a first end located at centerline 84 and a second end extended through centerpoint 191 of interface 186. Cam 112 is urged to move by drive flange 106 when the inertial force, provided by counterweight 194, and inherent frictional forces are overcome by force $\vec{F}$ exerted by drive flange 106 of the crankshaft 36. Due to the position of angle θ at contact interface 186, a component $F_1$ of force $\vec{F}$ is directed along interface 186 as illustrated. In contrast, an angle θ of 0° would direct a negligible force $F_1$ along interface 186, resulting in insignificant sliding engagement between cam 112 and crankshaft 36, hence, angle θ is preferably a non-zero value. The force $F_1$ urges movement of cam 112 along the direction of interface 186 and as a result sliding engagement between drive and driven surfaces 108, 118 ensues. An angle θ between 5° and 60° produces a sufficient force $F_1$, directed along interface 186, to promote sliding engagement between drive and driven surfaces 108, 118 to prevent direct sudden abutment of these surfaces.

The sudden and significant impact of the cam and crank as they engage presented by prior art compressors is avoided by compressor assembly 20 since energy is dissipated during engagement, over a period of time, through sliding engagement between drive and driven surfaces 108, 118. Referring to FIG. 10, in the reverse direction of crankshaft rotation 130, drive and driven surfaces 110, 120 comprise interface 190 at angle α formed relative to radially extended reference 193 originating from centerline axis 84 of crankpin 80 and extending through centerpoint 195 of contact interface 190. Similar to angle θ of interface 186, angle α, which may be between 5° and 60°, produces a force directed along interface 190 which facilitates sliding engagement rather than direct, abutting impact.

Referring to FIG. 2, inboard crankpin 82 includes a pair of radially positioned oil passages (only passage 200 shown) extending from opposite locations on surface 202 into crankpin 82 and communicate with longitudinally extending oil passage 204 (FIG. 8) within crankshaft 36. In a well known manner, oil from sump 60 (FIG. 1) is pumped through longitudinal passage 204 and provided to the sliding interface between surface 202 and the surrounding interior bearing surface (not shown) of connecting rod assembly 92. In a similar manner, outboard crankpin 80 includes a pair of radial positioned oil passages (only passage 206 shown) extending from opposite locations on surface 182 and into crankpin 80. The radial passages are fluidly connected with the above-mentioned longitudinal oil passage 204 in the crankshaft 36.

Referring to FIG. 5, cam 112 includes oil passages 208 and 210 which respectively extend through first and second members 132, 134 of cam 112 to allow oil to communicate between bearing surface 124 and crankpin surface 182 through cam 112. In each of the forward and reverse rotational directions, passages 208 and 210 are both respectively aligned with the respective oil passages provided radially through crankpin 80, thereby providing a supply of oil to the interface between surface 162 of cam 112 and the interfacing surface 124 of surrounding connecting rod assembly 90. A portion of the oil which flows from radial passages in crankpin 80 is also supplied to the interface between lateral face 114 of cam 112 and lateral surface 170 of camshaft 36 (FIG. 1).

Referring to FIG. 6A, an oil film is captured between drive surface 108 of drive flange 106 and driven surface 118 of raised member 116 as the drive member engages the driven member. Consequently, as the oil film is squeezed from interface 186 a dampening effect is produced and as a result wear on the engaging surfaces is significantly reduced. The squeezing of oil from interface 186 coincides with gradual energy dissipation, as a shock absorbing effect, as engagement and disengagement ensues.

Referring to FIG. 6B, the force $\vec{F}$ exerted by drive flange 106 of crankshaft 36 on cam 112 includes a component of force $F_2$ directed normal or perpendicular to interface 186.

The thickness of the oil film between drive surface 108 and driven surface 118 depends on the magnitude of force $F_2$. For example, a large force $F_2$ tends to squeeze a significant amount of oil from interface 186. The force $F_2$ may be varied by varying the angle θ. For instance, if θ was selected to be substantially zero, coinciding with a value of $\vec{F}$ substantially equal to $F_2$, a significant amount of oil would be squeezed from interface 186 corresponding to a high degree of dampening. However, since a significant amount of oil is expelled from between drive surface 108 and driven surface 118, only an insignificant amount of oil would remain therebetween for lubrication. Hence, a non-zero angle θ between 5° and 60° is preferred.

A centrifugal force $F_{CF}$ develops as cam 112 begins to rotate and is outwardly and radially directed relative to the centerline 84 of crankpin 80. The centrifugal force $F_{CF}$ acts to radially displace the cam 112, albeit slightly, relative to the crankshaft. As a result, a sliding action between drive surface 108 and driven surface 118 develops, having a dampening or shock absorbing effect located at interface 186. Moreover, sliding caused by centrifugal force $F_{CF}$ prevents separation and corresponding impact during low torque operation or reexpansion, for example, of the compressor since cam 112 is urged into contact with drive surface 108 of crankshaft 36 by centrifugal force $F_{CF}$. Furthermore, counterweight 194 is positioned about the cam to increase the oil film thickness between the drive surface 108 and driven surface 118 to accordingly facilitate lubricated sliding at interface 186. The centrifugal force FCF acting on cam 112 reduces the component of force $F_2$ perpendicular to interface 186 and consequently less oil is squeezed from interface 186.

Again referring to FIG. 6B, it may be seen that dampening between cam 112 and crankshaft 36, is provided when the oil film, located in clearance 180 between inner surface 178 of cam 112 and outer surface 182 of crankpin 80, is displaced. Upon engagement of drive surface 108 of drive flange 106 and driven surface 118 of cam 112, clearance 180 is decreased at location 212 proximate interface 186. By decreasing clearance 180 at location 212, a gradual dampening effect occurs as drive and driven surfaces 108, 118 engage and oil is squeezed from the clearance. It will be understood by those having ordinary skill in the art that the contact interface angle θ directing force $F_1$ along interface 186, resulting in oil being squeezed from clearance 180 and from between drive and driven surfaces 108, 118, produces a significant dampening effect as drive flange 106 engages driven portion 116.

Figure 9:
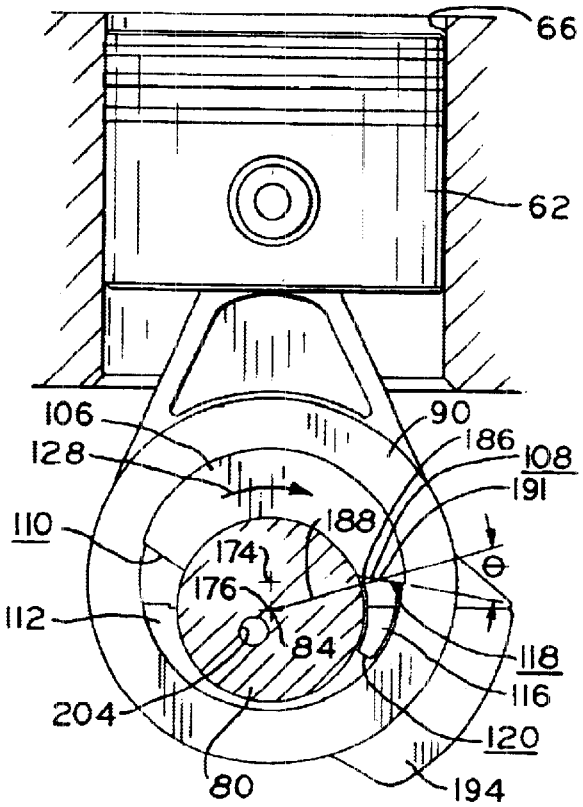
FIG. 9 is an end view of the crankshaft and cam assembly of FIG. 8, showing the cam assembly driven in a forward direction of rotation of the crankshaft.
Figure 10:
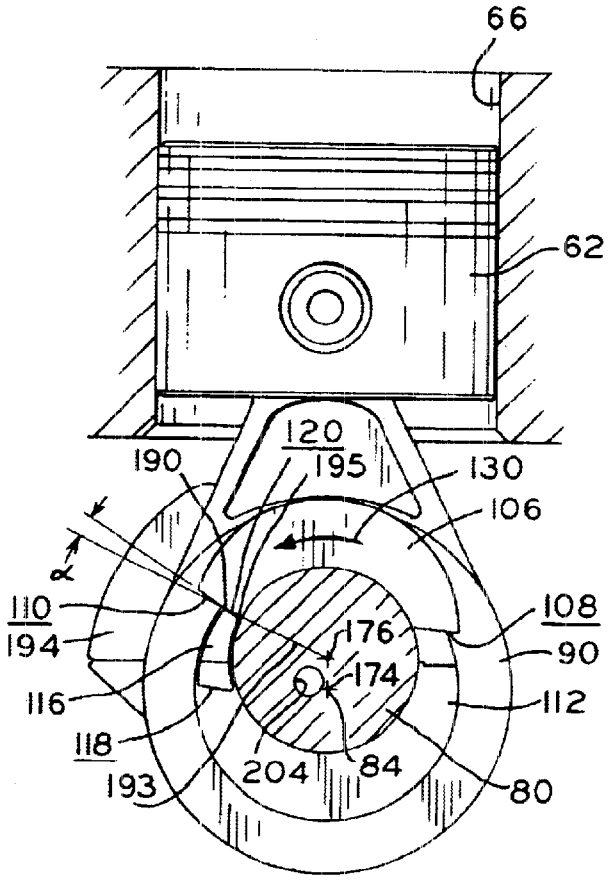
FIG. 10 is an end view of the crankshaft and eccentric cam assembly of FIG. 8, showing the cam assembly driven in a reverse direction of rotation of the crankshaft.
Figure 11:
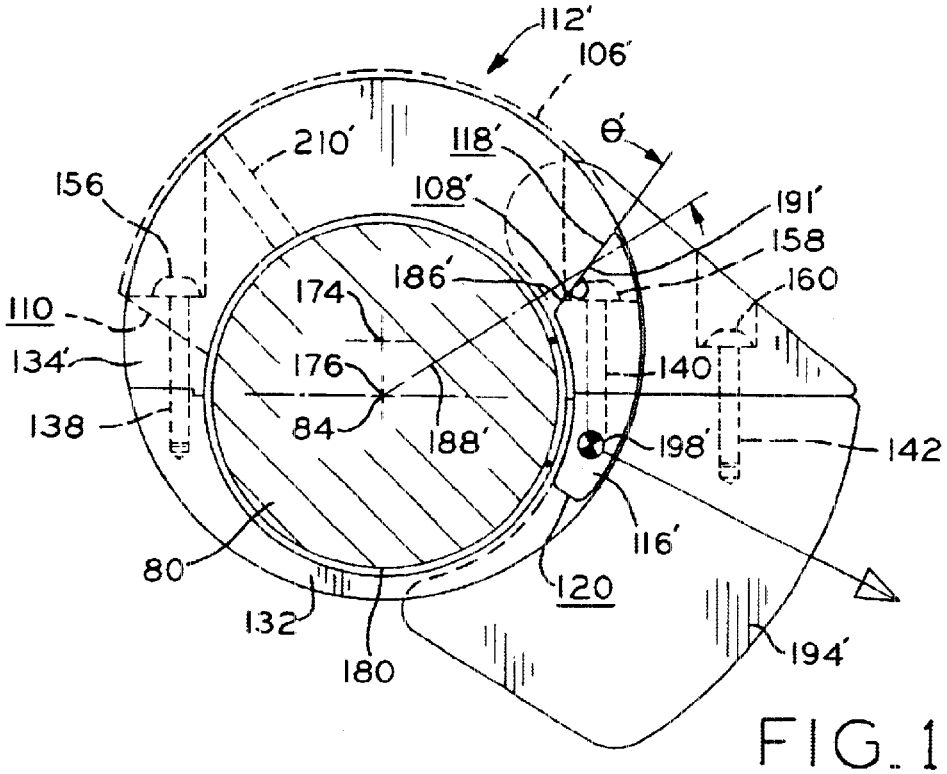
FIG. 11 is an end view of a second embodiment of a cam assembly of a compressor according to the present invention, showing the crankshaft drive flange in ghosted lines and the crankshaft in section.
Figure 12:
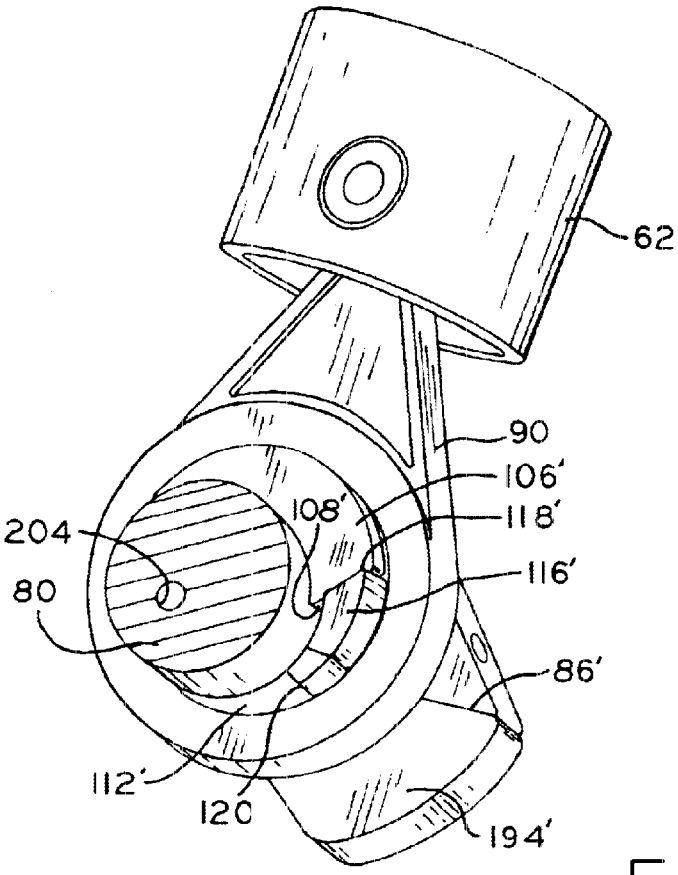
FIG. 12 is a perspective view of the crankshaft and cam assembly of FIG. 11, showing the crankshaft in section, shown engaged with its piston and connecting rod assembly.

Referring to FIG. 9, in operation, drive and driven surfaces 108 and 118 are in abutment as cam 112 is driven in the forward direction of rotation 128 and piston 62 has a stroke of twice the eccentricity (2e) and the stroke is equivalent to the distance between crankshaft axis of rotation 88 (FIG. 2) and central axis 174 of cam 112. During forward rotation in the direction of arrow 128, axes 84 and 174 are equally eccentric (each having eccentricity e) relative to the crankshaft axis of rotation 88 and pistons 62 and 64 have a common stroke distance (i.e., 2×e) and common displacement. Forward rotation of crankshaft 36 causes compressor assembly 20 to have its maximum displacement.

In contrast, with reference to FIG. 10 during reverse rotation of crankshaft 36, eccentric cam assembly 112 is driven in a reverse direction of rotation, as illustrated by arrow 130, compressor assembly 20 achieves only a portion (as shown, one half) its maximum displacement and piston 62 has zero stroke. Those having ordinary skill in the art will appreciate that, between the two cylinders, different stroke lengths or cylinder bore sizes may also be employed, and it is envisioned that the above described arrangement may be modified to produce a reduced displacement which is greater than or less than one half of the maximum displacement. Further, the present invention may be adapted to single cylinder compressors which have a first displacement when rotated in the forward direction, and a second, different displacement when rotated in reverse direction.

Figure 13:
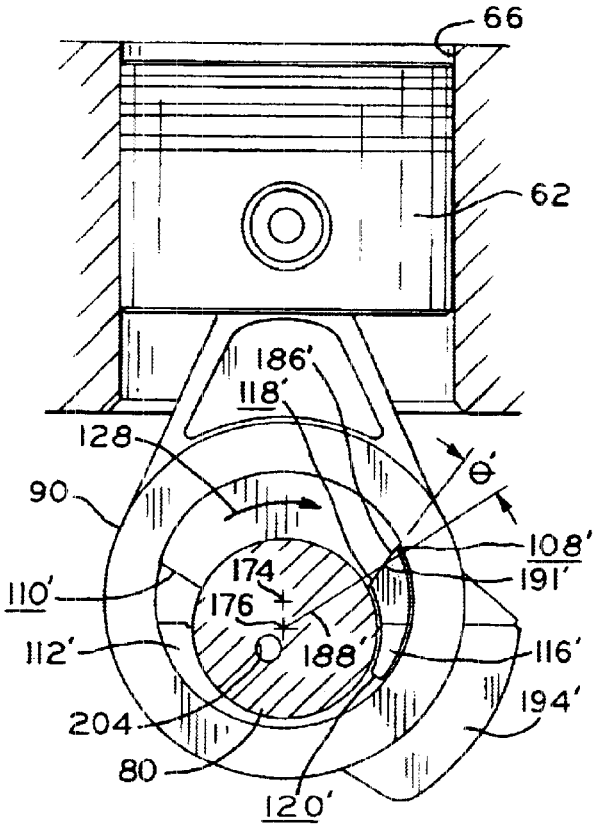
FIG. 13 is an end view of the crankshaft and eccentric cam assembly of FIG. 12, showing the cam assembly driven in a forward direction of rotation of the crankshaft.
Figure 14:
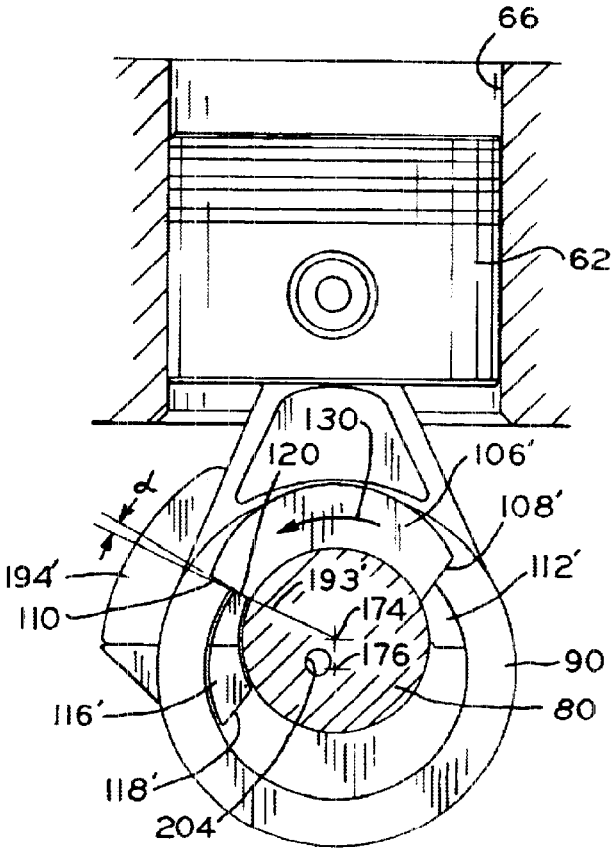
FIG. 14 is an end view of the crankshaft and eccentric cam assembly of FIG. 12, showing the cam assembly driven in a reverse direction of rotation of the crankshaft.

Referring to FIGS. 11–14, a second embodiment of a compressor assembly including a modified cam according to the present invention is depicted. Certain elements include primed reference numerals which indicate that the corresponding element previously described within the first embodiment has been modified. The second embodiment of a compressor assembly includes cam 112' and differs from cam 112 of the first embodiment by having contact interface 186' positioned at angle θ' relative to a radially extended reference 188' originating from centerline axis of crankpin 80. In the exemplary embodiment, during forward rotation of the compressor assembly, angle θ' is between 5° and 60° and during reverse rotation (FIG. 14) of the compressor assembly, angle α' is between 5° and 60°, for example. In operation, which is depicted in FIG. 13 (forward rotation) and FIG. 14 (reverse rotation), the second embodiment compressor assembly, and corresponding modified cam assembly 112', operates substantially identical to the first embodiment compressor assembly previously described. Those having ordinary skill in the art will understand that by altering angle θ' of interface 186', components of force $F_1'$, $F_2'$ may be predetermined to cause sliding engagement and disengagement, and control the oil film thickness, between the drive and driven surfaces.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reversible reciprocating piston compressor comprising:

a crankcase defining at least one cylinder therein;

a crankshaft which rotates in opposite, forward and reverse directions, said crankshaft rotatably supported by said crankcase and including a crankpin eccentrically positioned relative to an axis of rotation of said crankshaft, said crankshaft including a drive portion attached thereto;

a piston reciprocable within said cylinder;

a connecting rod assembly disposed between said crankpin and said piston to reciprocally drive said piston in response to forward or reverse rotation of said crankshaft; and a cam assembly operably connected to said crankpin and being engageable with said drive member to effectuate a first stroke length in a first direction of rotation of said crankshaft and a second stroke in a second direction of rotation of said crankshaft, said cam assembly comprising:

a cam interposed between said connecting rod assembly and said crankpin;

a driven portion attached to said cam and in a contacting relationship with said drive portion through at least one contact interface, said contact interface being oriented at a non-zero angle to a radial reference originating from a centerline axis of said crankpin; and a counterweight attached to said cam and having a center of mass located radially adjacent to or through said contact interface, wherein said drive portion is engageable and disengageable with said driven portion through sliding movement of said drive portion relative to said driven portion along said contact interface.

2. The reversible reciprocating piston compressor of claim 1, wherein said counterweight and said driven portion are axially spaced and substantially radially aligned.

3. The reversible reciprocating piston compressor of claim 1, wherein said cam assembly comprises an outer periphery rotatingly engaged with said connecting rod assembly and an inner surface rotatingly engaged with said crankpin, said cam assembly defining a radially disposed oil passage extending between said outer periphery and said inner surface of said cam assembly.

4. The reversible reciprocating piston compressor of claim 3, wherein said crankshaft includes a longitudinal passage within said crankshaft in fluid communication with a radial passage provided in said crankpin, said oil conduit is in fluid communication with said longitudinal passage.

5. The reversible reciprocating piston compressor of claim 1, wherein said driven portion of said cam is provided with first and second driven surfaces, said drive portion member of said crankshaft comprises a flange having first and second drive surfaces, said first driven surface and said first drive surface are engaged in said first direction of rotation, said second driven surface and said second drive surface are engaged in said second direction of rotation.

6. The reversible reciprocating piston compressor of claim 1, wherein said cam assembly comprises a plurality of pieces, said cam pieces interfitted about said crankpin and peripherally retained by said connecting rod assembly.

7. The reversible reciprocating piston compressor of claim 1, wherein one of said first and second piston stroke lengths is zero.

8. The reversible reciprocating piston compressor of claim 1, wherein said counterweight and said cam are integrally formed.

9. A reversible reciprocating piston compressor comprising:

a crankcase defining at least one cylinder therein;

a crankshaft which rotates in opposite, forward and reverse directions, said crankshaft rotatably supported by said crankcase and including a crankpin eccentrically positioned relative to an axis of rotation of said crankshaft, said crankshaft including a drive portion attached thereto;

a piston reciprocable within said cylinder;

a connecting rod assembly disposed between said crankpin and said piston to reciprocally drive said piston in response to forward or reverse rotation of said crankshaft; and a cam assembly operably connected to said crankpin and being engageable with said drive member to effectuate a first stroke length in a first direction of rotation of said crankshaft and a second stroke in a second direction of rotation of said crankshaft, said cam assembly comprising:

a cam interposed between said connecting rod assembly and said crankpin;

a driven portion attached to said cam and in a contacting relationship with said drive portion through at least one contact interface, said contact interface being oriented at a non-zero angle to a radial reference originating from a centerline axis of said crankpin; and a counterweight attached to said cam and being structured and arranged to provide an inertial force directed through a center of mass of said cam, said center of mass of said cam is located radially adjacent or through said contact interface, wherein said engaged driven portion and said drive portion resist separation under the influence of said inertial force.

10. A reversible reciprocating piston compressor comprising:

a crankcase defining at least one cylinder therein;

a crankshaft which rotates in opposite, forward and reverse directions, said crankshaft rotatably supported by said crankcase and including a crankpin eccentrically positioned relative to an axis of rotation of said crankshaft, said crankshaft including a drive portion attached thereto;

a piston reciprocable within said cylinder;

a connecting rod assembly disposed between said crankpin and said piston to reciprocally drive said piston in response to forward or reverse rotation of said crankshaft; and cam assembly operably connected to said crankpin and being engageable with said drive member to effectuate a first stroke length in a first direction of rotation of said crankshaft and a second stroke in a second direction of rotation of said crankshaft, said cam assembly comprising:

a cam interposed between said connecting rod assembly and said crankpin;

a driven portion attached to said cam and in a contacting relationship with said drive portion through at least one contact interface, said contact interface being oriented at a non-zero angle to a radial reference originating from a centerline axis of said crankpin; and a counterweight attached to said cam and being structured and arranged to provide a centrifugal force on said cam assembly when said crankshaft has attained a running speed, said centrifugal force urges a reduction in a force of contact exerted by said drive portion on said driven portion to thereby retain a film of lubricating oil between said drive and driven portions.

11. The reversible reciprocating piston compressor of claim 10, wherein said drive portion and said driven portion provide first and second contact interfaces, said first contact interface corresponding with a forward rotation of said crankshaft and said second contact interface corresponding with a reverse rotation of said crankshaft, said second contact interface being oriented at a non-zero angle to a radial reference originating from said centerline axis of said crankpin.

12. The reversible reciprocating piston compressor of claim 11, wherein said second contact interface is comprised of a second drive portion on said crankshaft and a second driven portion on said cam, said centrifugal force urges a reduction in a second force of contact exerted by said second drive portion on said second driven portion to thereby retain a film of lubricating oil between said second drive and said second driven portions.

13. The reversible reciprocating piston compressor of claim 10, wherein said cam and said crankshaft are separated by a clearance and oil within clearance is displaced in response to radial movement of said cam relative to said crankpin during engagement between said drive and driven portions, wherein said displacement of oil corresponding to a damped engagement between said drive portion and said driven portion.

14. The reversible reciprocating piston compressor of claim 10, wherein said drive and said driven portions are separated by a film of oil and said film of oil is partially displaced in response to radial movement of said cam relative to said crankshaft during engagement between said drive and driven portions, wherein partial displacement of said film of oil corresponds to a damped engagement between said drive portion and said driven portion.

15. The reversible reciprocating piston compressor of claim 10, wherein said cam assembly comprises a plurality of pieces, said cam pieces interfitted about said crankpin and peripherally retained by said connecting rod assembly.

16. The reversible reciprocating piston compressor of claim 10, wherein one of said first and second piston stroke lengths is zero.

17. The reversible reciprocating piston compressor of claim 10, wherein said counterweight and said cam are integrally formed.

18. A reversible reciprocating piston compressor comprising:

a crankcase defining at least one cylinder therein;

a crankshaft which rotates in opposite, forward and reverse directions, said crankshaft rotatably supported by said crankcase and including a crankpin eccentrically positioned relative to an axis of rotation of said crankshaft, said crankshaft including a drive portion attached thereto;

a piston reciprocable within said cylinder;

a connecting rod assembly disposed between said crankpin and said piston to reciprocally drive said piston in response to forward or reverse rotation of said crankshaft;

a cam assembly operably connected to said crankpin and being engageable with said drive member to effectuate a first stroke length in a first direction of rotation of said crankshaft and a second stroke in a second direction of rotation of said crankshaft, said cam assembly including a cam interposed between said connecting rod assembly and said crankpin and a driven portion attached to said cam and in a contacting relationship with said drive portion through at least one contact interface, said contact interface being oriented at a non-zero angle to a radial reference originating from a centerline axis of said crankpin; and means for slidably engaging and disengaging said drive portion with said driven portion through sliding movement of said drive portion relative to said driven portion along said contact interface.

19. The reversible reciprocating piston compressor of claim 18, further comprising means for preventing separation of said drive portion with said driven portion during a first mode corresponding to compressor start up and a second mode corresponding to the compressor in a run condition.

20. A method for compressing gas with a reciprocating piston compression device, comprising:

receiving a gas to be compressed into a cylinder of the compression device;

rotating a crankshaft drive member in a first rotational direction;

engaging a first surface of a camshaft driven member with a first surface of the crankshaft drive member through sliding movement between the drive and driven members whereby the drive member gradually engages the driven member through sliding movement therebetween;

driving the cam in the first rotational direction;

moving a piston operably connected to the cam assembly a first stroke distance;

compressing the gas within the cylinder of the compression device;

rotating the crankshaft drive member in a second rotational direction such that a second surface of a crankshaft drive member is rotated in a second rotational direction opposite the first rotational direction;

engaging a second surface of the camshaft driven member with the second surface of the crankshaft drive member through sliding movement between the drive and driven members;

driving the cam in the second rotational direction; and moving the piston operably connected to the cam assembly a second stroke distance which is less than the first stoke distance.

21. The method of claim 20, further comprising the step of imparting an inertial force on the drive member by the cam assembly whereby separation of the crankshaft and cam assembly is resisted.

22. The method of claim 20, further comprising the step of decreasing a film of lubrication fluid disposed between a rotational bearing surface on the cam assembly and a rotational bearing surface of the crankshaft during engagement of the drive member and the cam assembly in at least one rotational direction.

23. The method of claim 20, further comprising:

imparting a centrifugal force on the cam assembly during a run condition of the compressor; and preventing a film of lubrication fluid from being expelled from an engagement between the drive member and the cam assembly.

24. The method of claim 20, wherein the second piston stroke distance is substantially zero.

25. The method of claim 20, wherein the step of compressing the gas within the cylinder of the compression device further comprises:

compressing the gas to a first discharge pressure level corresponding to the first stroke distance and compressing the gas to a second discharge pressure level corresponding to the second stroke distance.

* * * * *

UNITED STATES PATENT AND TRADEMARK OFFICE

CERTIFICATE OF CORRECTION

PATENT NO. : 6,619,926 B2 
DATED : September 16, 2003
INVENTOR(S) : Dan M. Manhole et al.

It is certified that error appears in the above-identified patent and that said Letters Patent is hereby corrected as shown below:

Column 12,
Line 29, before "cam" insert -- a --

Signed and Sealed this

Sixth Day of January, 2004

JAMES E. ROGAN
*Director of the United States Patent and Trademark Office*